US006644066B1

(12) United States Patent
Dolcich

(10) Patent No.: US 6,644,066 B1
(45) Date of Patent: Nov. 11, 2003

(54) METHOD AND APPARATUS TO RELIEVE LIQUID PRESSURE FROM RECEIVER TO CONDENSER WHEN THE RECEIVER HAS FILLED WITH LIQUID DUE TO AMBIENT TEMPERATURE CYCLING

(75) Inventor: Benedict J. Dolcich, Westerville, OH (US)

(73) Assignee: Liebert Corporation, Columbus, OH (US)

( * ) Notice: Subject to any disclaimer, the term of this patent is extended or adjusted under 35 U.S.C. 154(b) by 0 days.

(21) Appl. No.: 10/172,757

(22) Filed: Jun. 14, 2002

(51) Int. Cl.[7] ..... F25B 39/04; F25B 5/00
(52) U.S. Cl. ..... 62/509; 62/DIG. 17
(58) Field of Search ..... 62/509, DIG. 17, 62/81, 278, 324.5, 151, 277

(56) References Cited

U.S. PATENT DOCUMENTS

| | | | | | |
|---|---|---|---|---|---|
| 4,231,229 | A | | 11/1980 | Willitts | 62/196 A |
| 4,430,866 | A | | 2/1984 | Willitts | 62/196.4 |
| 4,437,317 | A | | 3/1984 | Ibrahim | 62/81 |
| 4,522,037 | A | | 6/1985 | Ares et al. | 62/196.4 |
| 4,735,059 | A | | 4/1988 | O'Neal | 62/196.4 |
| 4,831,835 | A | | 5/1989 | Beehler et al. | 62/196.1 |
| 4,852,364 | A | * | 8/1989 | Seener et al. | 62/225 |
| 5,070,705 | A | | 12/1991 | Goodson et al. | 62/197 |
| 5,115,644 | A | | 5/1992 | Alsenz | 62/181 |
| 5,197,297 | A | * | 3/1993 | Brendel et al. | 62/81 |
| 5,524,819 | A | | 6/1996 | Heffner et al. | 236/92 B |
| 5,582,023 | A | * | 12/1996 | O'Neal | 62/195 |
| 5,596,878 | A | * | 1/1997 | Hanson et al. | 62/160 |
| 5,626,025 | A | | 5/1997 | Hyde | 62/117 |
| 5,634,347 | A | * | 6/1997 | Hanson et al. | 62/120 |
| 5,878,589 | A | | 3/1999 | Tanaka et al. | 62/199 |
| 6,082,128 | A | | 7/2000 | Lake et al. | 62/324.6 |
| 6,205,798 | B1 | * | 3/2001 | Porter et al. | 62/129 |
| 6,286,322 | B1 | * | 9/2001 | Vogel et al. | 62/81 |
| 6,418,741 | B1 | * | 7/2002 | Nungessor et al. | 62/225 |
| 6,481,231 | B2 | * | 11/2002 | Vogel et al. | 62/278 |

* cited by examiner

*Primary Examiner*—Melvin Jones
(74) *Attorney, Agent, or Firm*—Howrey Simon Arnold & White LLP

(57) ABSTRACT

A method and apparatus is disclosed to relieve liquid pressure from a receiver to a condenser in a cooling system that operates under a variety of ambient temperature conditions. To relieve excess pressure in the receiver and to prevent the venting of refrigerant through a relief valve, a pressure-balancing system is connected between the condenser and the receiver of the cooling system. In one embodiment, the pressure-balancing system includes a check valve and a pressure-balancing valve. The pressure-balancing valve bypasses the check valve. The check valve permits the flow of refrigerant in one direction from the condenser to the receiver. The pressure-balancing valve permits the flow of refrigerant in an opposite direction from the receiver to the condenser in order to maintain the pressure in the receiver below a maximum pressure level. The pressure-balancing valve may be installed on a bypass line parallel to the check valve. Alternatively, the check valve and the pressure-balancing valve may be installed in a single body.

22 Claims, 4 Drawing Sheets

METHOD AND APPARATUS TO RELIEVE LIQUID PRESSURE FROM RECEIVER TO CONDENSER WHEN THE RECEIVER HAS FILLED WITH LIQUID DUE TO AMBIENT TEMPERATURE CYCLING

FIELD OF THE INVENTION

The present invention relates generally to a cooling system, and, more particularly to a method and apparatus to relieve liquid pressure from a receiver to a condenser when the receiver is filled with liquid refrigerant due to ambient temperature cycling.

BACKGROUND OF THE INVENTION

Electronic equipment in a critical space, such as a computer room or telecommunication room, requires precise, reliable control of room temperature, humidity and airflow. Excessive heat or humidity can damage or impair the operation of computer systems and other components. For this reason, precision cooling systems are operated to provide cooling in these situations.

Precision cooling systems are often operated year round. Maintaining pressure levels in precision cooling systems that operate year round presents a number of challenges. Under low, ambient temperature conditions, the condenser may be exposed to a temperature as much as 75 degrees Fahrenheit lower than the evaporator temperature. To operate efficiently when the condenser is significantly cooler than the evaporator, head pressure in the condenser must be maintained.

When outdoor temperature conditions are warmer, refrigerant in the condenser may be warmed during an off-cycle and may undergo thermal expansion. Refrigerant may then accumulate in parts of the cooling system, such as a receiver. The pressure may rise above a maximum level, causing a relief valve to open and vent the excess pressure from the system.

The present invention is directed to overcoming, or at least reducing the effects of, one or more of the problems set forth above.

SUMMARY OF THE INVENTION

One aspect of the present invention provides a cooling system, including a condenser, a receiver and a means for balancing pressure between the condenser and the receiver. The receiver is connected to the condenser. The pressure-balancing means maintains a desired pressure differential between the receiver and the condenser and prevents pressure in the receiver above a maximum pressure level.

Another aspect of the present invention provides a cooling system, including a condenser, a receiver, a check valve and a pressure-balancing valve. The receiver is connected to the condenser. The check valve is connected between the condenser and the receiver and permits refrigerant flow from the condenser to the receiver. The pressure-balancing valve is connected between the condenser and the receiver and permits refrigerant flow from the receiver to the condenser in response to a predetermined pressure differential between the receiver and the condenser.

Yet another aspect of the present invention provides a method of balancing pressure in a cooling system. The method includes the step of maintaining a desired pressure differential between a receiver and a condenser by allowing refrigerant flow from the condenser to the receiver when a first pressure differential occurs between the condenser and the receiver. The method also includes preventing receiver pressure above a predetermined level by allowing refrigerant flow from the receiver to the condenser when a second pressure differential occurs between the receiver and the condenser.

The foregoing summary is not intended to summarize each potential embodiment, or every aspect of the invention disclosed herein, but merely to summarize the appended claims.

BRIEF DESCRIPTION OF THE DRAWINGS

The foregoing summary, a preferred embodiment and other aspects of the present invention will be best understood with reference to a detailed description of specific embodiments of the invention, which follows, when read in conjunction with the accompanying drawings, in which.

Figure 1:
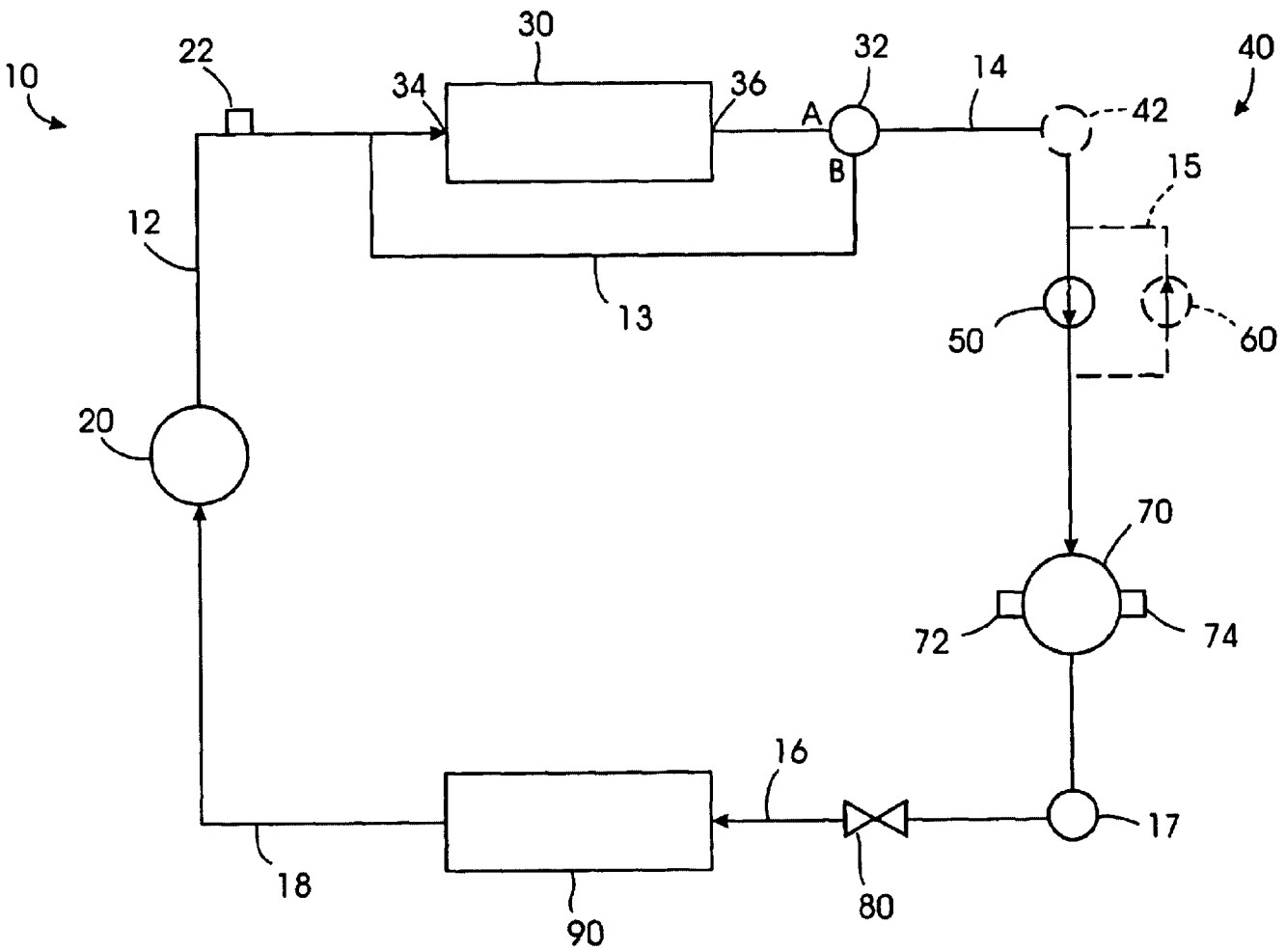
FIG. 1 schematically illustrates a cooling system in accordance with the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the scope of the invention as defined by the appended claims.

DETAILED DESCRIPTION OF THE INVENTION

Referring to FIG. 1, a cooling system 10 is schematically illustrated. Cooling system 10 includes a compressor 20, a condenser 30, an expansion mechanism 80 and an evaporator 90. For the purposes of example only, representative values for the cooling system 10 described herein are based upon a 1 to 1.5 ton cooling system using the hydrochloroflourocarbon R-22 as a refrigerant. It is understood that refrigerant used in cooling system 10 may be any chemical refrigerant, including chloroflourocarbons (CFCs), hydroflourocarbons (HFCs), or other hydrochloro-flourocarbons (HCFCs). It is also understood that a cooling system with a different cooling capacity and/or using a different refrigerant will have other representative values than those presented below.

As described above, cooling system 10 may be used to cool a critical space, such as a computer room. As such, cooling system 10 may operate year round under a large range of ambient temperature conditions and cycles. Cooling system 10 may need to maintain head pressure in condenser 30 during low, outdoor ambient temperature conditions. Therefore, cooling system 10 further includes a head pressure control valve 32, a receiver 70 and a liquid line solenoid valve 17.

During operation of cooling system 10, refrigerant is compressed in compressor 20, which may be a reciprocating, scroll or other type of compressor. After compression, the refrigerant travels through a discharge line 12 to an inlet 34 of condenser 30. A high head pressure switch 22 may be connected to discharge line 12 to protect cooling system 10 from damaging high pressures occurring upon start-up or during operation. High head pressure switch 22 shuts down compressor 20 if the discharge pressure exceeds a predetermined level. In condenser 30, heat from the refrigerant is dissipated to an external heat sink, e.g. the outdoor environment.

Upon leaving condenser 30, refrigerant travels through a first liquid line 14 and through a pressure-balancing system 40 connected on liquid line 14 between head pressure control valve 32 and receiver 70. Pressure-balancing system 40 includes a check valve 50, which is normally closed. During operation of cooling system 10, check valve 50 opens at a very low pressure differential, such as 1 psig., to allow refrigerant to flow from condenser 30 to receiver 70. When cooling system 10 is off, however, check valve 50 prevents the return of liquid refrigerant from receiver 70 to condenser 30.

From check valve 50, refrigerant enters receiver 70, where it may be temporarily stored or accumulated. Leaving receiver 70, refrigerant travels through a liquid line solenoid valve 17 installed on liquid line 16. Liquid line solenoid 17 is closed during off-cycles to prevent the migration of liquid refrigerant from receiver 70 to evaporator 90. Liquid refrigerant migrating through evaporator 90 may enter compressor 20, which may be detrimental to the system at start-up.

Past the open liquid line solenoid 17, the refrigerant then travels to expansion mechanism 80. Expansion mechanism 80 may comprise a valve, orifice or other possible expansion apparatus known to those of ordinary skill in the art. As the refrigerant passes through the mechanism, expansion mechanism 80 produces a pressure drop in the refrigerant.

Upon leaving expansion mechanism 80, the refrigerant continues through liquid line 16, arriving at evaporator 90, which comprises a heat exchanger coil. Refrigerant passing through evaporator 90 absorbs heat from the environment to be cooled. Specifically, air or fluid from the environment or critical space to be cooled circulates through the evaporator coil, where it is cooled by heat exchange with the refrigerant. Refrigerant carrying the heat extracted from the environment then returns to compressor 20 by suction line 18, completing the refrigeration cycle.

As noted, cooling system 10 may be operated even when the outdoor ambient temperature is approximately 100° F. or more below the indoor ambient temperature of the critical space to be cooled. For example, a typical indoor ambient temperature for the critical space may be about 70° F., while the outdoor ambient temperature may be about −30° F. With these ambient temperature conditions, condenser 30 is significantly cooler than evaporator 90. To maintain adequate head pressure, the capacity of condenser 30 must be reduced or restricted using a pressure control valve 32 and receiver 70.

Pressure control valve 32 is disposed on liquid line 14 between condenser 30 and check valve 50. Head pressure control valve 32 is a three-way valve having a first port A and a second port B. First port A is connected to outlet 36 of condenser 30. Second port B is connected to a bypass discharge line 13 that connects to discharge line 12 and bypasses condenser 30. Head pressure control valve 32 operates to maintain a minimum condensing pressure in condenser 30 and to maintain a minimum pressure in receiver 70.

Receiver 70 is a tank or pressure vessel, sized to hold the excess refrigerant that would otherwise flood condenser 30. Receiver 70 includes a pressure relief valve 72 and may include a heater 74. For safety, pressure relief valve 72 may be set to open at about 450 psig (3103 kPa). Heater 74 may be temperature compensated to maintain the liquid refrigerant pressure in receiver 70 within a predetermined range during off-cycles. Heater 74 may turn off during operation of cooling system 10 and/or when the pressure in receiver 70 is high. For example, the heater 74 may have a cut in of about 100 psig (690 kPa) and may have a cut out of about 160 psig (1034 kPa).

During operation under low ambient temperatures, or at initial start-up, control valve 32 meters discharge gas from bypass discharge gas line 13 to receiver 70. The discharge gas fills receiver 70 to maintain operating pressures. Fluid communication from condenser outlet 36 to receiver 70 is not permitted through port A, and liquid refrigerant is backed into condenser 30 to reduce its working volume.

As described above, cooling system 10 uses receiver 70 to hold the refrigerant charge during low ambient temperature conditions. Receiver 70 is typically not large enough to contain the entire charge of refrigerant for the system. When coolin g system 10 is off, an ambient temperature cycle may occur due to a temperature increase in the outside environment. Exposed to the outside environment, condenser 30 warms.

During the ambient temperature cycle, condenser 30 increases in temperature more rapidly than receiver 70, which is typically insulated. The pressure of the refrigerant in condenser 30 temporarily increases above that in receiver 70. Due to a resulting pressure differential, refrigerant migrates from condenser 30, through check valve 50, and into receiver 70. As noted above, liquid line solenoid 17 is normally closed during the off-cycle of cooling system 10 to prevent migration of refrigerant from receiver 70 to evaporator 90. With continued time and ambient temperature cycling, receiver 70 eventually fills entirely with liquid refrigerant.

A subsequent temperature increase of receiver 70 then causes liquid refrigerant in the receiver to expand, as dictated by thermal expansion coefficients. The refrigerant expands faster than the shell or tank of receiver 70. Relief valve 72 on the receiver 70 opens and vents refrigerant to the atmosphere. Relief valves are not pressure regulators. Once opened, typical relief valves may not reliably reseal. When refrigerant charge is vented through relief valve 72, the valve must be replaced. Replacing relief valve 72 requires evacuating and recharging the system, which is expensive and time-consuming.

In one embodiment of the present invention to solve the problems caused by ambient temperature cycling discussed above, a normally closed valve 42, such as a solenoid valve, is installed on liquid line 14 upstream of check valve 50. To prevent excessive pressure in receiver 70, solenoid valve 42 is closed when cooling system 10 is off or when power is not supplied to the system. In this way, thermally expanding refrigerant is not allowed to migrate from condenser 30 to receiver 70. Solenoid valve 42 is opened when cooling system 10 is operating. A controller, wiring and a control signal (all not shown) may operate solenoid valve 42.

In another embodiment of the present invention to solve the problems caused by ambient temperature cycling discussed above, pressure-balancing system 40 releases a controlled amount of liquid from receiver 70 to condenser 30. In a preferred embodiment of the present invention, pressure-balancing system 40 includes a high-differential check valve or pressure-balancing valve 60. Pressure-balancing system 40 can have pressure-balancing valve 60 on a bypass line 15, which bypasses check valve 50 on first liquid line 14. Alternatively, pressure-balancing system 40 can have check valve 50 and pressure-balancing valve 60 housed together in a dual check valve apparatus, such as discussed below in FIGS. 4A–B, and connected to first liquid line 14. Responding to a high pressure differential between receiver 70 and condenser 30, pressure-balancing valve 60 bypasses check valve 50 and routes expanding liquid refrigerant from receiver 70 back to condenser 30.

To avoid the venting of refrigerant to atmosphere during ambient temperature cycling as described above, the pressure in receiver 70 is ideally maintained below an opening pressure of relief valve 72. To prevent excessive pressure in receiver 70, pressure-balancing valve 60 is calibrated to open when a predetermined pressure differential occurs between receiver 70 and condenser 30. Under low ambient temperature conditions, however, cooling system 10 operates more efficiently when a desired pressure differential is maintained between receiver 70 and condenser 30. Thus, pressure-balancing valve 60 does not allow refrigerant to flow back to condenser 30 from receiver 70 unless the predetermined pressure differential occurs between receiver 70 and condenser 30.

For R-22 in cooling system 10 with an example cooling capacity of 1 to 1.5 ton, the opening pressure for relief valve 72 may be approximately 450 psig. The highest pressure expected in condenser 30 during idle, high ambient temperature conditions may be approximately 300 psig. Furthermore, the desired pressure differential between receiver 70 and condenser 30 during low ambient conditions may be up to approximately 140 psig. Therefore, pressure-balancing valve 60 may be calibrated to open, for example, when the predetermined pressure differential between receiver 70 and condenser 30 rises above 140 psig. Of course, this value is a function of the thermal properties of the refrigerant used and other design considerations within the abilities of one of ordinary skill in the art having the benefit of this disclosure.

Thus, pressure-balancing valve 60 relieves pressure from receiver 70 to prevent opening of relief valve 72, yet still allows pressurization of condenser 30 during low ambient temperature conditions. Pressure-balancing valve 60 operates automatically without a control signal or wiring. A minimum desired pressure in receiver 70 is maintained by keeping the desired pressure differential between receiver 70 and condenser 30. Moreover, excessive pressure is prevented in receiver 70 by releasing accumulated liquid back to condenser 30. The present invention avoids unwanted venting of refrigerant to the atmosphere because of ambient temperature cycling while still maintaining the safety feature of relief valve 72.

Figure 2A:
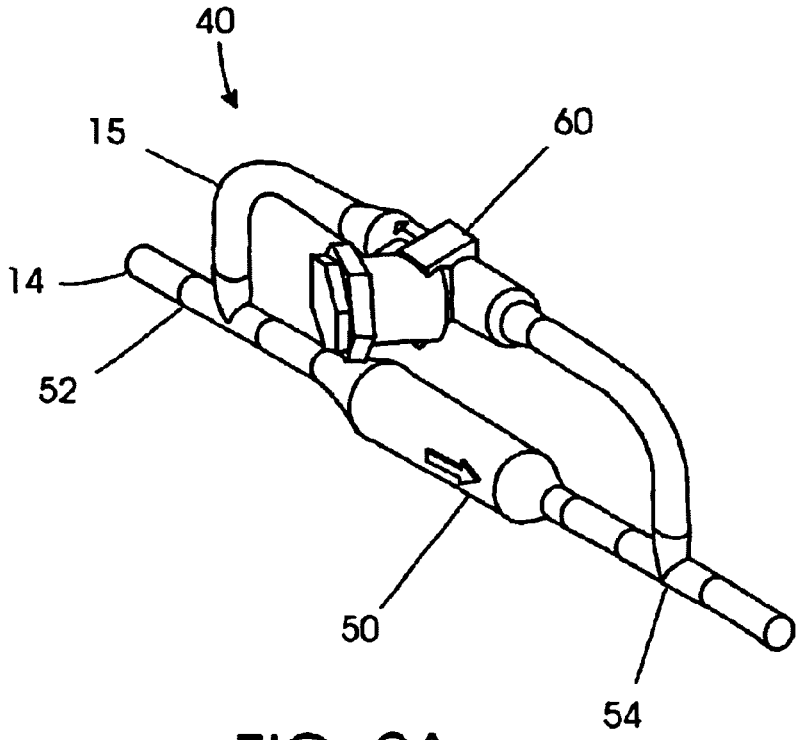
FIGS. 2A–B illustrate an embodiment of a check valve and a pressure-balancing valve in accordance with the present invention.
Figure 2B:
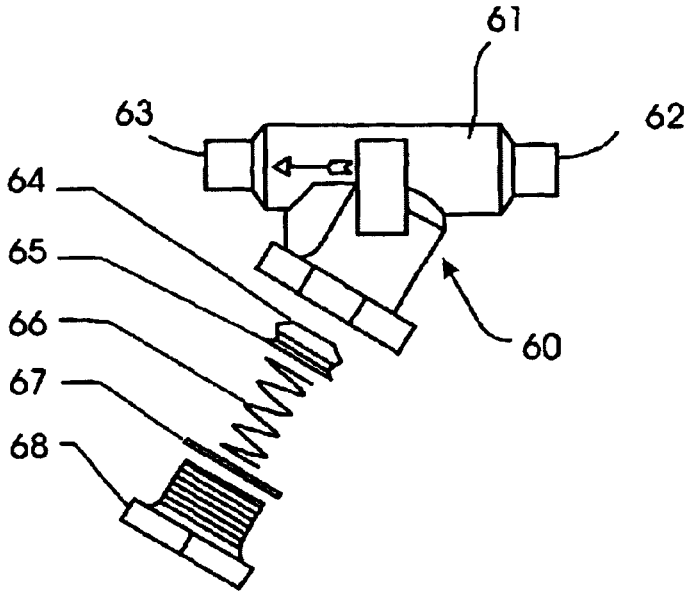

Referring to FIGS. 2A–B, an embodiment of pressure-balancing system 40 in accordance with the present invention is illustrated. Pressure-balancing system 40 includes check valve 50 and pressure-balancing valve 60. Check valve 50 is connected in-line to first line or liquid line 14 and permits flow of refrigerant in one direction from the condenser to the receiver. On the upstream side of check valve 50, a first tee-connector 52 is connected to liquid line 14. On the downstream side of check valve 50, a second tee-connector 54 is also connected to liquid line 14. A second line or bypass line 15 connects to the first and second tee-connectors 52 and 54. Pressure balancing valve 60 is disposed on bypass line 15 and permits a reverse flow of refrigerant from the receiver to the condenser.

Referring to FIG. 2B, pressure-balancing valve 60 is shown in an exploded view. Pressure-balancing valve 60 includes a housing 61 having an inlet 62 and an outlet 63. Pressure balancing valve 60 further includes a seat 64, a poppet 65, a spring 66, a seal 67 and a cap 68. Seat 64, preferably made of Teflon, is disposed on poppet 65. Spring 66 is disposed between cap 68 and poppet 65. Cap 68 attaches to housing 61 and maintains seat 64, poppet 65 and spring 66 within the housing 61. Attachment of cap 68 to housing 61 may be sealed by the seal ring 67.

Within housing 61, seat 64 is biased by spring 66 to suitably engage an orifice defined in the housing between inlet 62 and outlet 63. The spring, poppet and seat construction may be calibrated to open when a predetermined pressure occurs at inlet 62. Check valve 50 of FIG. 2A may include a similar construction of spring, poppet and seat calibrated to open at another predetermined pressure.

Figure 3B:
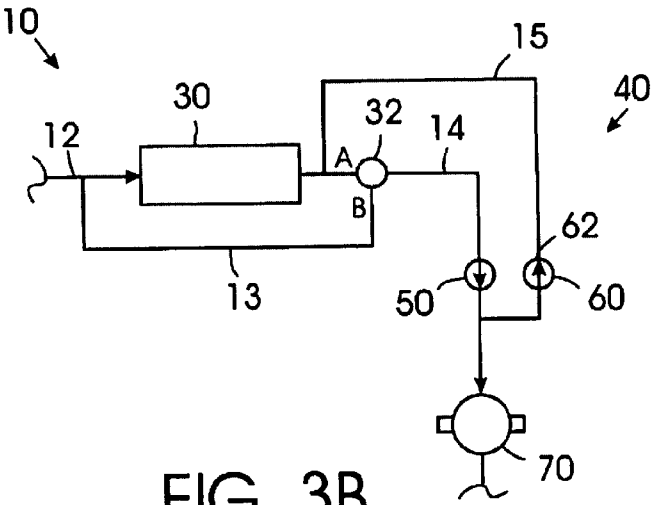
FIGS. 3A–C schematically illustrate other embodied arrangements of a pressure-balancing system in accordance with the present invention.
Figure 3A:
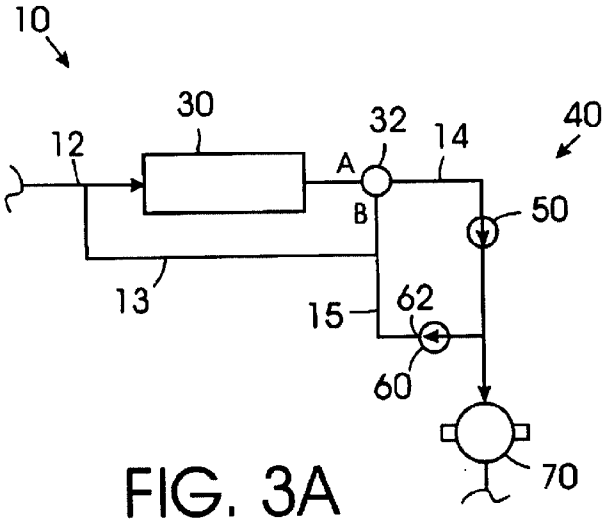
Figure 3C:
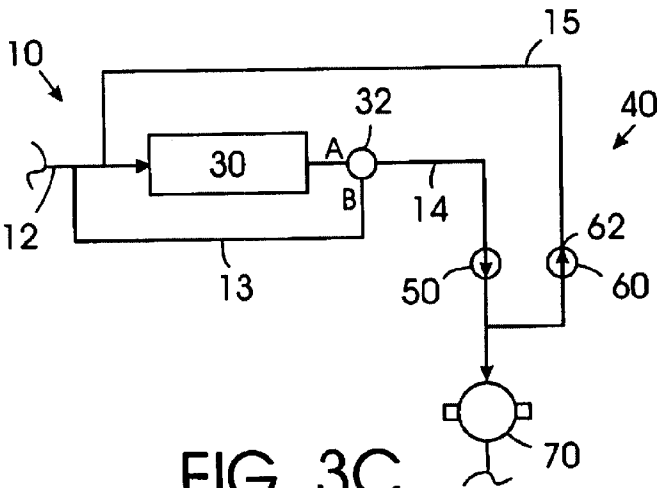

Referring to FIGS. 3A–C, pressure-balancing system 40 in accordance with the present invention is schematically illustrated in a number of other possible arrangements. In FIGS. 3A–3C, a portion of cooling system 10 is depicted, showing discharge line 12, condenser 30, bypass discharge line 13, liquid line 14, pressure control valve 32, pressure-balancing system 40, and receiver 70.

As before, pressure-balancing system 40 includes check valve 50 on liquid line 14 between condenser 30 and receiver 70. Pressure-balancing valve 60 is disposed on bypass line 15. One end of bypass line 15 attaches to liquid line 14 between check valve 50 and receiver 70. In the arrangement of FIG. 3A, the other end of bypass line 15 routes outlet 62 of pressure-balancing valve 60 to bypass discharge line 13. Reverse flow of refrigerant from receiver 70 and through pressure-balancing valve 60 is directed upstream of the second port B of pressure control valve 32. The present arrangement may beneficially reduce the length of tubing for bypass line 15 and may thereby meet specific space limitations for an installation of cooling system 10. Unlike other arrangements, the present arrangement may avoid liquid refrigerant passing through pressure-balancing valve 60 from being immediately cycled back through check valve 50.

In the arrangement of FIG. 3B, the other end of bypass line 15 routes outlet 62 of pressure-balancing valve 60 to liquid line 14 between condenser 30 and control valve 32. Reverse flow of refrigerant from receiver 70 through pressure-balancing valve 60 is directed to the outlet of condenser 30 and upstream of the first port A of the control valve 32. The present arrangement may advantageously use properties of the control valve 32. For example, the control valve 32 may incorporate functions of check valve 50 and pressure-balancing valve 60.

In the arrangement of FIG. 3C, the other end of bypass line 15 routes outlet 62 of pressure-balancing valve 60 to discharge line 12 at the inlet of condenser 30. Flow of refrigerant from receiver 70 through pressure-balancing valve 60 is directed upstream of condenser 30 towards its inlet. The present arrangement facilitates the return of liquid refrigerant back to condenser 30 by advantageously directing liquid refrigerant to the inlet of condenser 30.

Figure 4A:
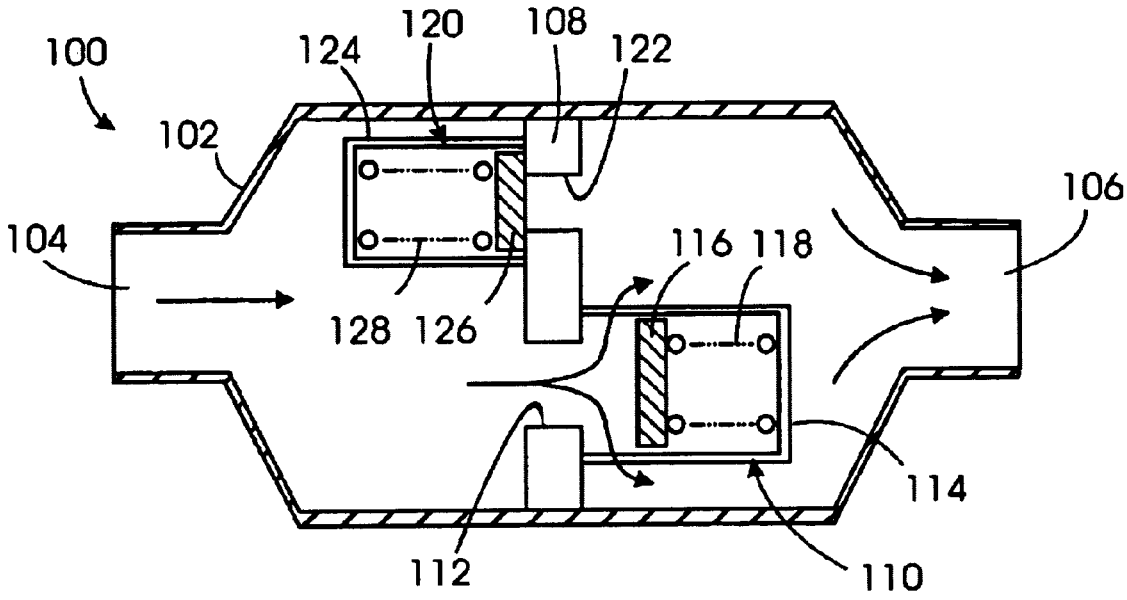
FIGS. 4A–B schematically illustrate an embodiment of a pressure-balancing system or dual check valve apparatus in accordance with the present invention.
Figure 4B:
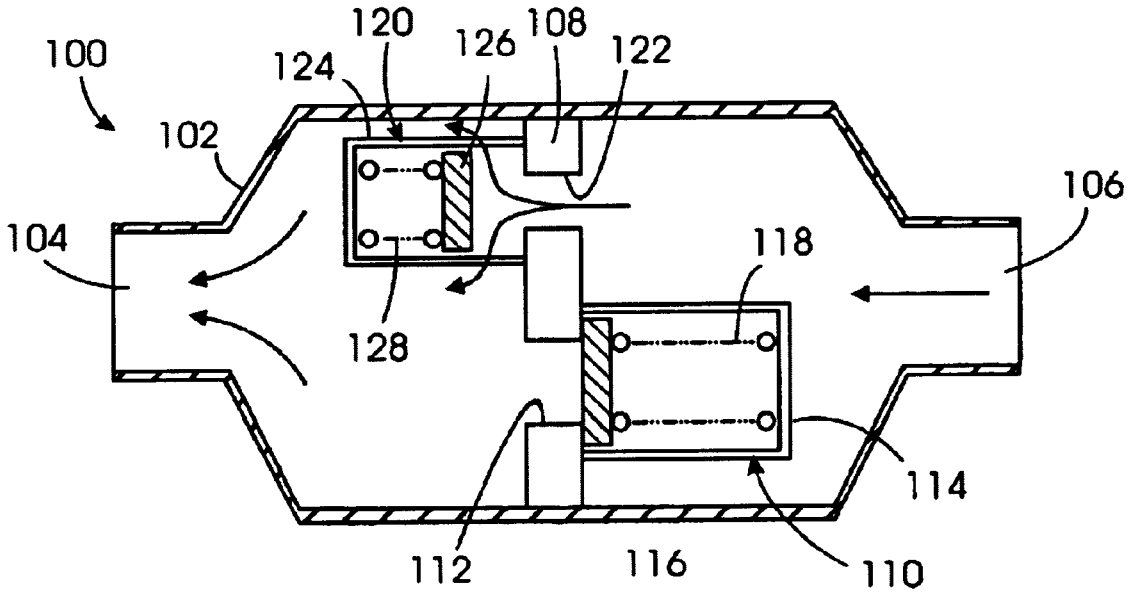

Referring to FIGS. 4A–B, a pressure-balancing system or dual check valve apparatus 100 is depicted in accordance with another embodiment of the present invention. Dual check valve apparatus 100 includes a body 102, shown here in cross-section, having a first port 104 and a second port 106. A divider plate 108 is disposed in body 102 between first port 104 and second port 106.

Dual check valve apparatus 100 includes a first check valve or main check valve 110 and a second check valve or pressure-balancing valve 120. First and second check valves 110 and 120 are parallel, reverse acting valves incorporated into the single body 102. First check valve or main check valve 110 includes a first aperture 112, a housing 114, a closure member or disc 116, and a biasing member or spring 118. First aperture 112 is defined in divider plate 108 for normal flow of refrigerant from the condenser connected to first port 104 to the receiver connected to second port 106.

Housing 114 is mounted to divider plate 108 adjacent first aperture 112. Closure member 116 and biasing member 118 are disposed within housing 114. Biasing member 118 urges closure member 116 into sealed engagement with first aperture 112. Check valve 110 permits refrigerant to flow in one direction from first port 104, through first aperture 112 and out second port 106.

Closure member 116 and biasing member 118 are calibrated to lose sealed engagement with first aperture 112 when a predetermined pressure differential occurs between first port 104 and second port 106. For example, main check valve 110 may open at a very low pressure differential, such a 1 psig., between first port 104 and second port 106. Main check valve 110 does not permit flow of the refrigerant from second port 106 to first port 104.

Similarly, second check valve or pressure-balancing valve 120 includes a second aperture 122, a housing 124, a closure member 126 and a biasing member 128. Second aperture 122 is defined in divider plate 108 for high-pressure flow of refrigerant from the receiver connected to second port 106 to the condenser connected to first port 104. Housing 122 is mounted to divider plate 108 on the side opposite to that of main check valve 110. Closure member 126 and biasing member 128 are disposed within housing 124. Biasing member 128 urges closure member 126 into sealed engagement with second aperture 122.

During initial start-up or when the head pressure in the condenser must be elevated, the pressure differential between first port 104 and second port 106 is insufficient to open first check valve 110 and second check valve 120. Refrigerant is not allowed through dual check valve 100 and may accumulate in the condenser.

During normal operation, pressure of the refrigerant from the condenser at first port 104 overcomes the biasing force of first biasing member 118. Closure member 116 is moved from sealed engagement with first aperture 112. Refrigerant is allowed to flow from the condenser to the receiver. For example, main check valve 110 may open if pressure at first port 104 is approximately 1 psi greater than the pressure at second port 106.

During ambient temperature cycling in an off-cycle, thermal expansion of the liquid refrigerant in the receiver may occur. A pressure differential may then develop between first port 104 and second port 106. Pressure-balancing valve 120 opens and allows for a reverse flow of refrigerant from the receiver to the condenser through second aperture 122 in divider plate 108. For example, the pressure-balancing valve 120 may open if the pressure differential is approximately 140 psig or above.

While the invention has been described with reference to the preferred embodiments, obvious modifications and alterations are possible by those skilled in the related art. Therefore, it is intended that the invention include all such modifications and alterations to the full extent that they come within the scope of the following claims or the equivalents thereof.

What is claimed is:

1. A cooling system comprising:

a condenser;

a receiver connected to the condenser; and means for balancing pressure between the receiver and the condenser, the pressure-balancing means maintaining a desired pressure differential between the receiver and the condenser and preventing pressure in the receiver above a maximum pressure level.

2. The cooling system of claim 1, wherein the desired pressure differential between the receiver and the condenser is up to approximately 140 psig.

3. The cooling system of claim 2, wherein the maximum pressure level in the receiver is approximately 450 psig.

4. The cooling system of claim 1, wherein the pressure-balancing means comprises:

a check valve connected between the condenser and the receiver and permitting refrigerant flow from the condenser to the receiver; and a second valve connected between the check valve and the condenser, the second valve being opened to allow refrigerant flow from the condenser to the receiver and being closed to prevent refrigerant flow from the receiver to the condenser.

5. The cooling system of claim 4, wherein the second valve comprises a normally closed solenoid valve.

6. The cooling system of claim 1, wherein the pressure-balancing means comprises:

a check valve connected between the condenser and the receiver and allowing refrigerant flow from the condenser to the receiver; and a pressure-balancing valve connected between the condenser and the receiver and allowing refrigerant flow from the receiver to the condenser in response to a predetermined pressure differential between the receiver and the condenser.

7. The cooling system of claim 6, wherein the predetermined pressure differential of the pressure-balancing valve is approximately 140 psig. between the receiver and the condenser.

8. A cooling system comprising:

a condenser:

a receiver connected to the condenser; and means for balancing pressure between the receiver and the condenser, the pressure-balancing means maintaining a desired pressure differential between the receiver and the condenser and preventing pressure in the receiver above a maximum pressure level, wherein the pressure-balancing means comprises:

a check valve connected between the condenser and the receiver and allowing refrigerant flow from the condenser to the receiver, and a pressure-balancing valve connected between the condenser and the receiver and allowing refrigerant flow from the receiver to the condenser in response to a predetermined pressure differential between the receiver and the condenser; and wherein the check valve and the pressure-balancing valve share a common housing.

9. A cooling system comprising:

a condenser;

a receiver connected to the condenser with a first line;

a check valve disposed on the first line and permitting refrigerant flow from the condenser to the receiver;

a second line having one end connected to the first line between the check valve and the receiver and having another end connected to the first line between the check valve and the condenser; and a pressure-balancing valve disposed on the second line and permitting refrigerant flow from the receiver to the condenser in response to a pressure differential between the receiver and the condenser.

10. A cooling system comprising:

a condenser connected to a discharge gas line;

a receiver connected to the condenser with a first line;

a check valve disposed on the first line and permitting refrigerant flow from the condenser to the receiver;

a second line having one end connected to the first line between the check valve and the receiver and having another end connected to the discharge gas line; and a pressure-balancing valve disposed on the second line and permitting refrigerant flow from the receiver to the condenser in response to a pressure differential between the receiver and the condenser.

11. A cooling system comprising:

a condenser connected to a discharge gas line;

a receiver connected to the condenser with a first line;

a check valve disposed on the first line and permitting refrigerant flow from the condenser to the receiver;

a control valve disposed on the first line between the check valve and the condenser;

a second line having one end connected to the first line between the check valve and the receiver and having another end connected to the first line between the condenser and the control valve; and a pressure-balancing valve disposed on the second line and permitting refrigerant flow from the receiver to the condenser in response to a pressure differential between the receiver and the condenser.

12. A cooling system comprising:

a condenser connected to a discharge gas line;

a receiver connected to the condenser with a first line;

a check valve disposed on the first line and permitting refrigerant flow from the condenser to the receiver;

a control valve disposed on the first line between the check valve and the condenser;

a bypass line connecting the discharge line to the control valve;

a second line having one end connected to the first line between the check valve and the receiver and having another end connected to the bypass line; and a pressure-balancing valve disposed-on the second line and permitting refrigerant flow from the receiver to the condenser in response to a pressure differential between the receiver and the condenser.

13. A device for balancing pressure between a condenser and a receiver, comprising:

a body having a first port connected to the condenser and having a second port connected to the receiver;

a first check valve disposed in the body and allowing refrigerant flow from the first port to the second port in response to a first pressure differential between the first port and the second port; and a second check valve disposed in the body and allowing refrigerant flow from the second port to the first port in response to a second pressure differential between the second port and the first port.

14. The device of claim 13, wherein the first pressure differential is approximately 1 psig. between the first port and the second port.

15. The device of claim 13, wherein the second pressure differential is approximately 140 psig. between the second port and the first port.

16. A device for balancing pressure between a condenser and a receiver, comprising:

a body having a first port connected to the condenser and having a second port connected to the receiver;

a first check valve disposed in the body and allowing refrigerant flow from the first port to the second port in response to a first pressure differential between the first port and the second port; and a second check valve disposed in the body and allowing refrigerant flow from the second port to the first port in response to a second pressure differential between the second port and the first port, wherein the first and second check valves are disposed on a plate in the body between the first port and the second port.

17. The device of claim 16, wherein the first and second check valves each comprise:

a housing attached to the plate;

a closure member disposed in the housing adjacent an aperture defined in the plate; and a biasing member disposed in the housing and urging the closure member into sealed engagement with the aperture.

18. A method of balancing pressure in a cooling system comprising the steps of:

maintaining a desired pressure differential between a receiver and a condenser by allowing refrigerant flow from the condenser to the receiver when a first pressure differential occurs between the condenser and the receiver; and preventing receiver pressure above a predetermined level by allowing refrigerant flow from the receiver to the condenser when a second pressure differential occurs between the receiver and the condenser.

19. The method of claim 18, wherein the first pressure differential is approximately 1 psig. between the condenser and the receiver.

20. The method of claim 18, wherein the desired pressure differential between the receiver and the condenser is up to approximately 140 psig.

21. The method of claim 20, wherein the second pressure differential between the receiver and the condenser is approximately 140 psig.

22. The method of claim 21, wherein the predetermined level is approximately 450 psig.

* * * * *